US006061904A

United States Patent [19]

Watanabe et al.

[11] Patent Number: 6,061,904

[45] Date of Patent: May 16, 2000

[54] HEAT EXCHANGER AND METHOD FOR MANUFACTURING THE SAME

[75] Inventors: Akimichi Watanabe, Maebashi; Hirotaka Kado, Isesaki, both of Japan

[73] Assignee: Sanden Corporation, Gunma, Japan

[21] Appl. No.: 09/084,237

[22] Filed: May 26, 1998

Related U.S. Application Data

[62] Division of application No. 08/637,273, Apr. 25, 1996, Pat. No. 5,785,119.

[30] Foreign Application Priority Data

May 30, 1995 [JP] Japan ..... 7-154041

[51] Int. Cl.[7] ..... F28F 9/02

[52] U.S. Cl. ..... 29/890.046; 29/890.03; 29/890.053

[58] Field of Search ..... 29/890.043, 890.046, 29/890.053, 523, 890.03

[56] References Cited

U.S. PATENT DOCUMENTS

| | | | |
|---|---|---|---|
| 475,656 | 5/1892 | Bertels | 285/203 |
| 484,696 | 10/1892 | Benbow | 285/222 |
| 1,382,049 | 10/1921 | Aspinwall | 285/222 |
| 1,438,596 | 12/1922 | Harding . | |
| 1,481,217 | 1/1924 | Maloy | 285/203 |
| 1,500,560 | 7/1924 | Henderson | 285/222 |
| 1,583,758 | 5/1926 | White . | |
| 1,721,621 | 7/1929 | Gamble | 29/890.043 |
| 1,898,713 | 2/1933 | Carrier et al. | 165/178 |
| 2,245,430 | 6/1941 | Courtright et al. | 285/202 |
| 3,027,142 | 3/1962 | Albers et al. | 165/178 |
| 3,390,738 | 7/1968 | Kirsch et al. | 285/382.2 |
| 4,026,456 | 5/1977 | Lema | 29/890.043 |
| 4,615,385 | 10/1986 | Saperstein et al. . | |
| 4,620,590 | 11/1986 | Koisuka et al. . | |
| 4,678,112 | 7/1987 | Koisuka et al. . | |
| 4,770,446 | 9/1988 | Keller | 285/222 |
| 4,957,158 | 9/1990 | Ando . | |
| 5,022,464 | 6/1991 | Aoli et al. . | |
| 5,094,293 | 3/1992 | Shinmura . | |
| 5,101,887 | 4/1992 | Kado . | |
| 5,178,209 | 1/1993 | Aoki et al. . | |
| 5,575,330 | 11/1996 | Hoeffken | 165/178 |

FOREIGN PATENT DOCUMENTS

| | | | |
|---|---|---|---|
| 0371532 | 6/1993 | European Pat. Off. . | |
| 2238545 | 2/1975 | France . | |
| 2272769 | 12/1975 | France . | |
| 703758 | 2/1941 | Germany . | |
| 9305497 | 6/1993 | Germany . | |
| 527182 | 5/1955 | Italy | 285/222 |
| 58-104867 | 7/1983 | Japan . | |
| 59-225900 | 12/1984 | Japan . | |
| 3-199897 | 8/1991 | Japan . | |
| 180592 | 7/1993 | Japan . | |
| 1095731 | 12/1967 | United Kingdom | 29/890.043 |

*Primary Examiner*—I. Cuda
*Attorney, Agent, or Firm*—BakerBotts, L.L.P.

[57] ABSTRACT

A heat exchanger includes a tank having a pipe insertion hole disposed in a tank wall and a fluid pipe connected to the tank wall for introducing a fluid into the tank or discharging the fluid from the tank. The tank wall has a burr formed around the pipe insertion hole extending toward an interior of the tank. The fluid pipe has a flange formed on its periphery by bending the fluid pipe onto itself. An end portion of the fluid pipe is inserted into the pipe insertion hole so that the flange contacts an outer surface of the tank wall, and the inserted end portion is expanded and caulked together with the burr. A brazing material may be fixed between the flange and the tank wall during brazing even during vibration. The length of the pipe inserted into the tank may be minimized. The contact area between the fluid pipe and the tank is thereby enlarged.

10 Claims, 5 Drawing Sheets

HEAT EXCHANGER AND METHOD FOR MANUFACTURING THE SAME

This application is a divisional of U.S. patent application Ser. No. 08/637,273, filed Apr. 25, 1996, entitled: Heat Exchanger and Method for Manufacturing the Same, now issued as U.S. Pat. No. 5,785,119.

BACKGROUND OF THE INVENTION

1. Field of the Invention

The present invention relates to heat exchangers and a method for manufacturing the same, and more particularly to an improved connection structure and connection method between a tank and a fluid pipe for heat exchangers.

2. Description of the Related Art

In a conventional heat exchanger having a tank and a fluid pipe connected to the tank, for example, a fluid inlet pipe or outlet pipe, brazing between the tank and the fluid pipe may be performed as follows. For example, FIG. 9 depicts a heat exchanger tank 104 having a pipe insertion hole 102 disposed in tank wall 103 of tank 104. A burr 101 may be formed around pipe insertion hole 102 to increase the surface area of tank 104 contacting fluid pipe 105, i.e., to enlarge the brazing area between tank 104 and fluid pipe 105. An end portion of fluid pipe 105 may be inserted into pipe insertion hole 102 so that a tip 110 of fluid pipe 105 may be positioned over a tip 111 of burr 101. The inserted fluid pipe 105 may be temporarily fixed to tank 104 by spot welding 106. Annular brazing material 107 may be placed around the periphery of fluid pipe 105 and brought into contact with an outer surface 108 of tank wall 103. Then, the assembly may be is heated in a furnace, whereby fluid pipe 105 is brazed to tank 104.

In such a conventional connecting and brazing structure, when the assembly is heated in a furnace, if any vibration occurs, annular brazing material 107 may shift away from outer surface 108 of tank wall 103. If shifting occurs, an insufficient amount of molten brazing material may remain in contact with burr 101 and fluid pipe 105 to form a good brazed and connected state between fluid pipe 105 and tank 104.

Further, the portion of fluid pipe 105 inserted into the interior of tank 104 is often relatively long. Consequently, the portion disrupts fluid flow in tank 104 resulting in significant pressure loss of fluid flow in the tank 104.

Furthermore, the contact area, i.e., brazing area, between tank 104 and fluid pipe 105 is relatively small. Hence, the connection strength between fluid pipe 105 and tank 104 may be insufficient.

SUMMARY OF THE INVENTION

Accordingly, it is an object of the present invention to provide a heat exchanger having a connection structure between a tank and a fluid pipe which can prevent undesired shifting of an annular brazing material during heating in a furnace, even if vibrations occur to the tank and fluid pipe assembly.

It is another object of the present invention to provide a method for manufacturing such a heat exchanger.

It is a further object of the present invention to minimize the length of a fluid pipe which is inserted into an interior of a tank, thereby minimizing pressure loss in the tank.

It is a still further object of the present invention to increase the contact area between a tank and a fluid pipe, thereby increasing the connection strength resulting from brazing therebetween.

These and other objects are achieved by a heat exchanger having a connection structure between a tank and a fluid pipe according to the present invention. A heat exchanger according to the present invention comprises a tank including a tank wall having a pipe insertion hole disposed in the tank wall. A fluid pipe may be connected to the tank wall for introducing a fluid into the tank or discharging a fluid from the tank. The tank wall may have a burr formed around the pipe insertion hole extending toward an interior of the tank. The fluid pipe may have a flange formed on a periphery of the fluid pipe by, for example, bending the fluid pipe onto itself. An end portion of the fluid pipe is inserted into the pipe insertion hole so that the flange contacts an outer surface of the tank wall. The inserted end portion of the fluid pipe is outwardly expanded and caulked together with the burr.

A method for manufacturing a heat exchanger according to the present invention comprises the steps of forming a burr extending toward an interior of a tank around a pipe insertion hole disposed in a tank wall of the tank, forming a flange on a periphery of a fluid pipe by, for example, bending the fluid pipe onto itself, inserting an end portion of the fluid pipe into the pipe insertion hole so that the flange contacts an outer surface of the tank wall, and expanding and caulking the inserted end portion of the fluid pipe together with the burr.

In such a heat exchanger and a method for manufacturing the same according to the present invention, because the flange is formed on the periphery of the fluid pipe, an annular brazing material may be placed on the periphery of the fluid pipe before insertion of the fluid pipe into the pipe insertion hole so that the annular brazing material engages the flange. Thereby, when the end portion of the fluid pipe is inserted into the pipe insertion hole and the flange is brought into contact with the outer surface of the tank wall, the annular brazing material may be securely fixed between the flange and the tank wall. Moreover, because the fluid pipe and the tank are heated and brazed in a furnace in the described assembly, the position of the annular brazing material may always be maintained at a desired position during heating, even if vibrations occur on the assembly. As a result, a sufficient amount of molten brazing material may be supplied to the connection portion between the fluid pipe and the tank wall, thereby ensuring a good brazed state.

Moreover, because the inserted end portion of the fluid pipe is expanded and caulked together with the burr, the length of the fluid pipe inserted into the interior of the tank may be minimized. Therefore, the pressure loss in the tank originating from the inserted portion of the fluid pipe into the tank may be minimized as compared with the conventional structure.

Further, because the flange contacts the outer surface of the tank wall and the inserted end portion of the fluid pipe contacts the burr formed on the tank wall, the contact area between the fluid pipe and the tank may be increased. Therefore, the connection strength therebetween and the brazing strength therebetween may also be increased.

Furthermore, because the inserted end portion of the fluid pipe is caulked together with the burr such that the inserted end portion of the fluid pipe extends over and is caulked together with the burr, the fluid pipe may be securely fixed to the tank. Also, the end opposite from the inserted end of the fluid pipe (a fluid introducing port or a fluid discharging port) may be precisely positioned before brazing. Therefore, a temporary fixing between the fluid pipe and the tank before brazing is not necessary, and a fixing during brazing such as one using a fixing jig is also unnecessary. As a result, the manufacturing process may be simplified, and the cost for the manufacture may be reduced.

Further objects, features, and advantages of the present invention will be understood from the detailed description of the preferred embodiments of the present invention with reference to the appropriate figures.

BRIEF DESCRIPTION OF THE DRAWINGS

Some preferred exemplary embodiments of the present invention will now be described with reference to the appropriate figures, which are given by way of example only, and are not intended to limit the present invention.

DETAILED DESCRIPTION OF THE PREFERRED EMBODIMENTS

Figure 1:
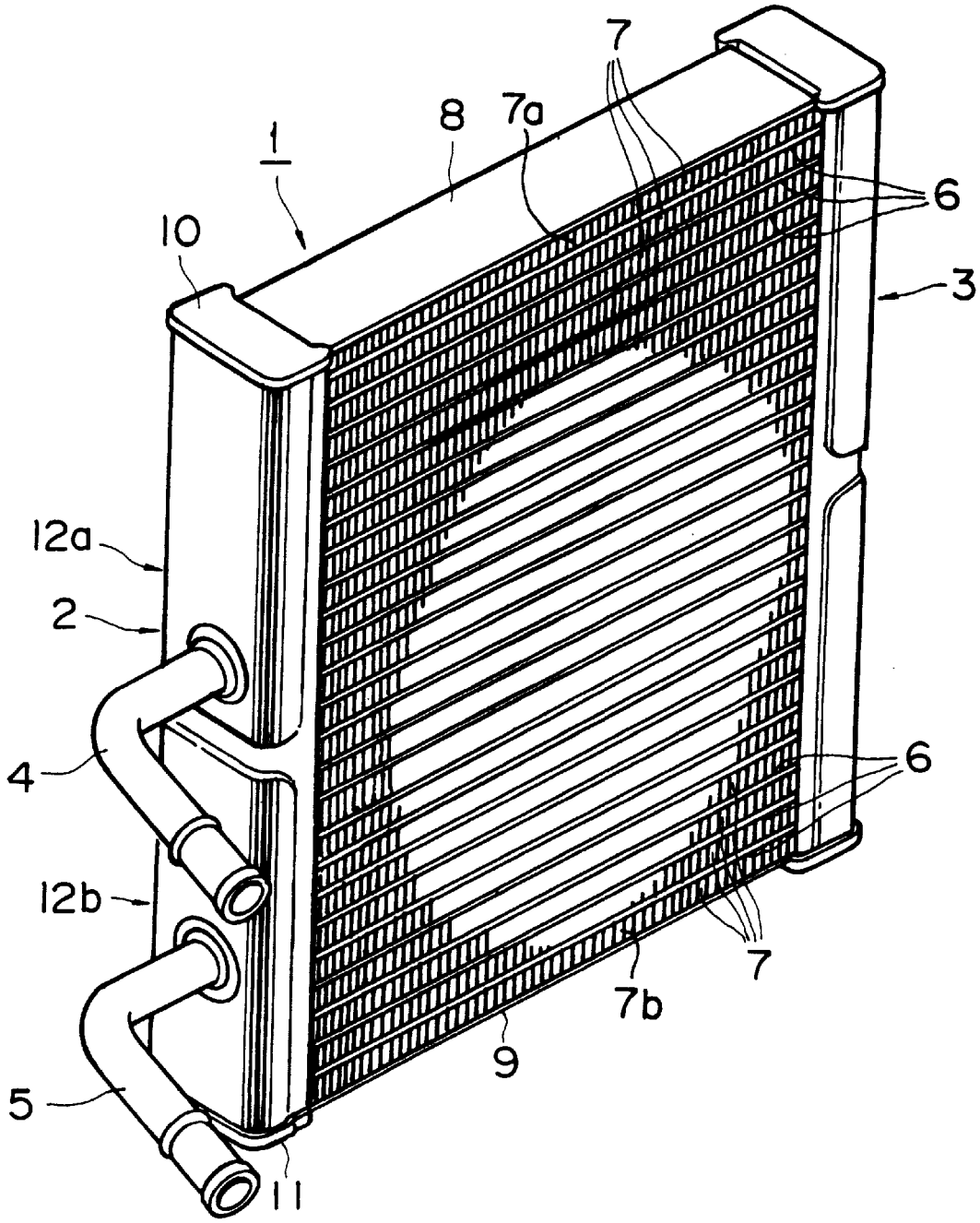
FIG. 1 is a perspective view of a heat exchanger according to an embodiment of the present invention.
Figure 2:
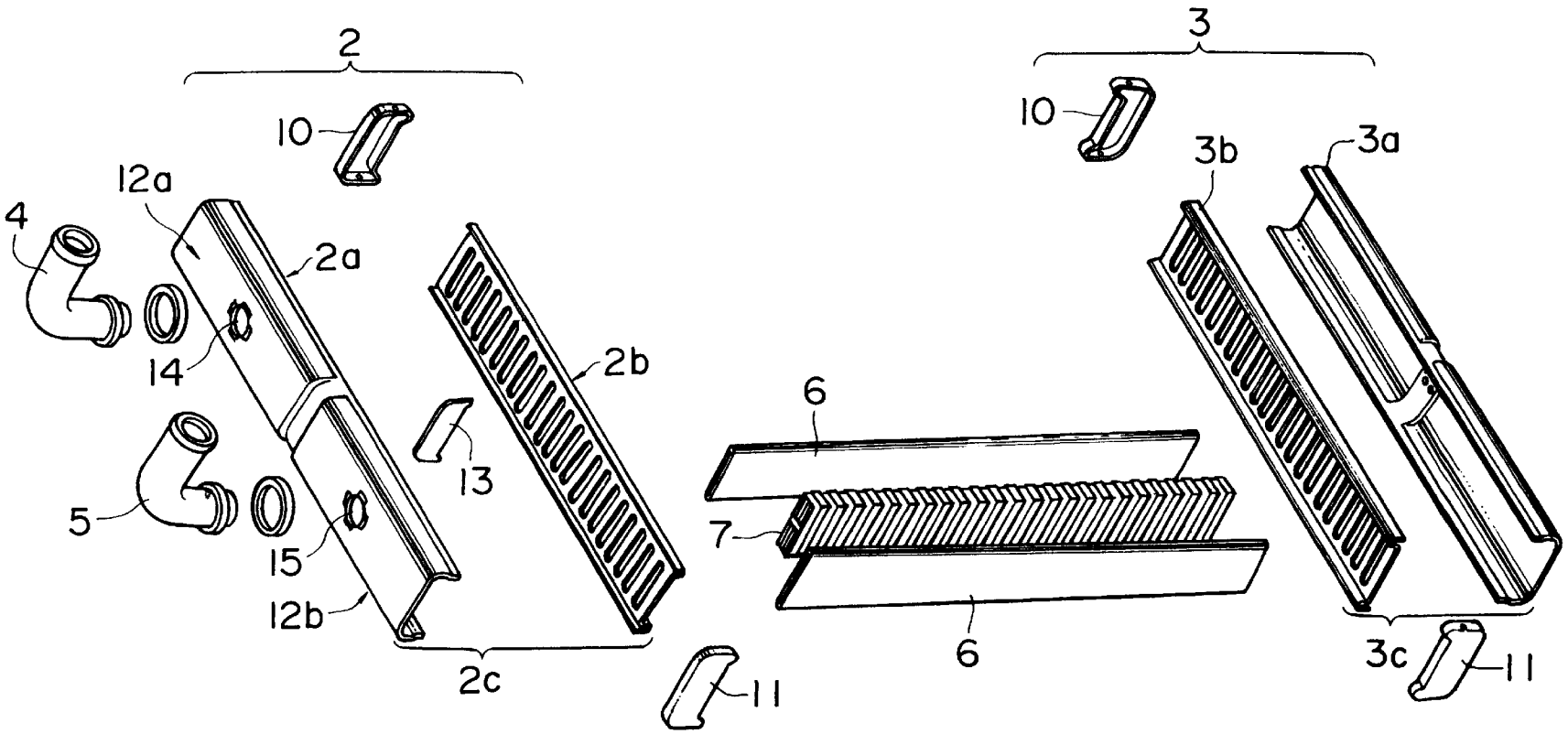
FIG. 2 is an exploded perspective view of the heat exchanger depicted in FIG. 1.

Referring to FIGS. 1 and 2, a heat exchanger 1 is provided according to an embodiment of the present invention. Heat exchanger 1 includes a pair of tanks 2 and 3. Each of tanks 2 and 3 may be constructed from tank member 2*a* or 3*a* and seat member 2*b* or 3*b* to form barrel 2*c* or 3*c*. Inlet pipe 4 and outlet pipe 5 may be provided as fluid pipes for introducing a fluid (for example, refrigerant) into tank 2 and discharging the fluid from tank 2, respectively. Inlet pipe 4 and outlet pipe 5 may be connected to tank 2 by brazing. A plurality of flat heat transfer tubes 6 (for example, refrigerant tubes) may be fluidly interconnected between tanks 2 and 3. Corrugated fins 7 may be disposed on either or both surfaces of each heat transfer tube 6. Side members 8 and 9 may be provided on the upper surface of the uppermost fin 7*a* and on the lower surface of the lowermost fin 7*b*, respectively. Each of tanks 2 and 3 may be closed at both longitudinal ends by caps 10 and 11, respectively. The interior of tank 2 may be divided into two sections 12*a* and 12*b* by partition 13 provided in tank 2.

Figure 3:
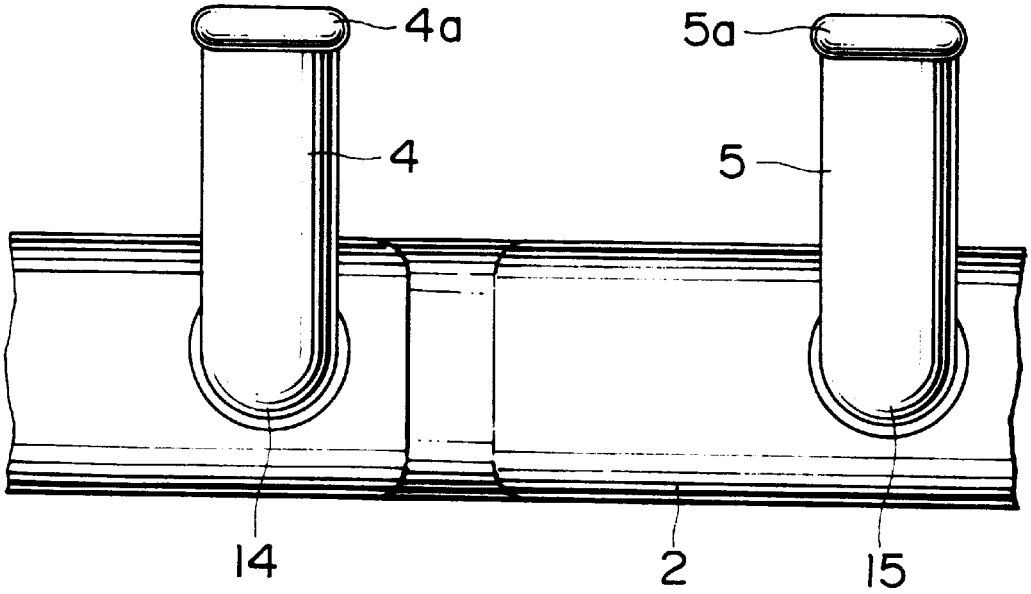
FIG. 3 is an enlarged elevational view of part of the heat exchanger depicted in FIG. 1.

One end of inlet pipe 4 and outlet pipe 5 may be connected to pipe insertion holes 14 and 15, respectively defined on tank member 2*a* of tank 2. The other ends of inlet pipe 4 and outlet pipe 5 form open ends 4*a* or 5*a* and function as a fluid introducing port or a fluid discharging port, as shown in FIGS. 2 and 3.

Inlet pipe 4 and outlet pipe 5 may be connected to tank 2 as follows. For purposes of explanation, connection of inlet pipe 4 will be described. Outlet pipe 5 may also be connected in the following manner. The term fluid pipe may refer to either inlet pipe 4 or outlet pipe 5.

Figure 4:
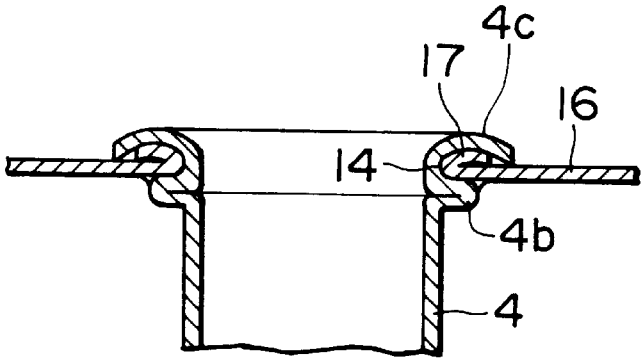
FIG. 4 is an enlarged vertical sectional view of a connection portion between a fluid pipe and a tank wall of the heat exchanger depicted in FIG. 1.
Figure 5:
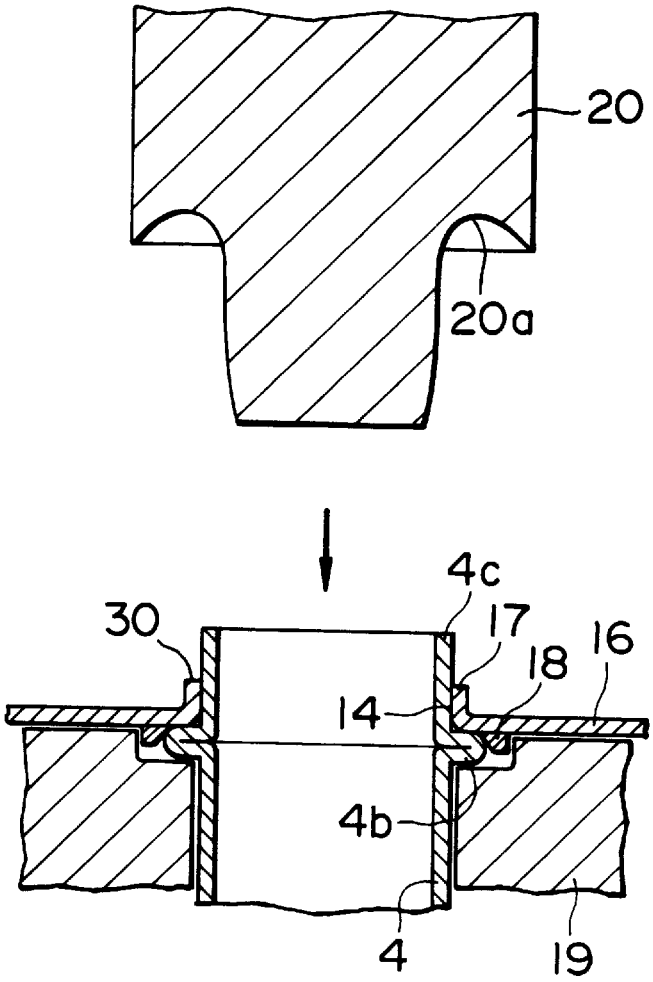
FIG. 5 is an enlarged vertical sectional view of the connection portion between the fluid pipe and the tank wall of the heat exchanger depicted in FIG. 1 and depicts a method for expanding and caulking an end portion of the fluid pipe together with a burr of the tank wall according to another embodiment of the present invention.
Figure 6:
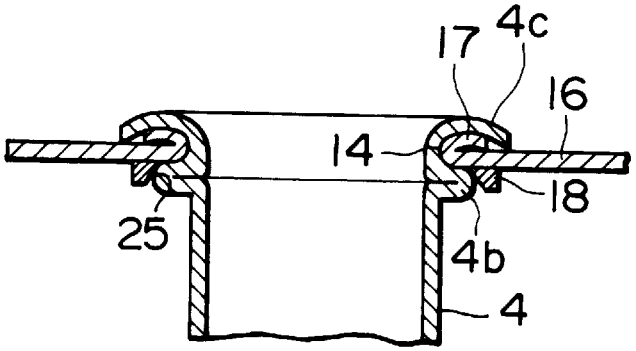
FIG. 6 is an enlarged vertical sectional view of the connection portion between the fluid pipe and the tank wall of the heat exchanger depicted in FIG. 1 prior to brazing.

Tank member 2*a* has a tank wall on which pipe insertion holes 14 and 15 are defined. As depicted in FIGS. 4–6, a burr 17 may be formed around pipe insertion hole 14 to extend toward the interior of tank 2. A flange 4*b* may be formed on the periphery of fluid pipe 4 near end portion 4*c* of fluid pipe 4. Flange 4*b* may be formed by bending fluid pipe 4 onto itself so a flange formation portion protrudes outwardly in the axial direction. Other methods of forming flange 4*b* may also be used. End portion 4*c* of fluid pipe 4 may be inserted through pipe insertion hole 14 extending toward the interior of tank 2.

Before end portion 4*c* of fluid pipe 4 is inserted into pipe insertion hole 14, annular brazing material 18 is placed around the periphery of end portion 4*c* of fluid pipe 4 so that annular brazing material 18 is brought into contact with flange 4*b*. Annular brazing material 18 may have an inner diameter smaller than an outer diameter of flange 4*b*. In this embodiment, annular brazing material 18 may have a trapezoidal cross section. In such a condition, end portion 4*c* of fluid pipe 4 may be inserted into pipe insertion hole 14 until flange 4*b* is brought into contact with the outer surface of tank wall 16, as depicted in FIG. 5. The inserted end portion 4*c* of fluid pipe 4 extends over tip 30 of burr 17. The assembly of tank member 2*a* (tank wall 16), fluid pipe 4 and annular brazing material 18 may be supported from the underside by lower jig 19. Punch 20 may be pressed from the upper side onto the inserted end portion 4*c* of fluid pipe 4. Punch 20 may have an annular caulking portion 20*a* formed as a curved recessed portion. End portion 4*c* of fluid pipe 4 may be caulked together with burr 17 by the dowmward pressing of punch 20. When punch 20 presses down on end portion 4*c* of fluid pipe 4 and burr 17, end portion 4*c* and burr 17 expand to open outwardly and become caulked to the surface of tank wall 16. End portion 4*c* is caulked so that the upper surface of end portion 4*c* is curved along caulking portion 20*a* of punch 20. In other words, the surface of the caulked end portion 4*c* facing the interior of tank 2 is formed as a curved surface convex toward the interior of tank 2. Such punching and caulking may be possible during manufacture because tank member 2*a* and seat member 2*b* of tank 2 are separate structures.

By the above-described caulking, as depicted in FIG. 6, fluid pipe 4 is fixed to tank wall 16 by caulked end portion 4*c* and to flange 4*b* by caulked burr 17. Also a tapered portion 25 of annular brazing material 18 may be provided. The taperd portion 25 may have a trapezoidal cross section and may be fixed between the outer surface of tank wall 16 and flange 4*b*. After caulking, the assembly is placed in a furnace, heated and brazed therein. Annular brazing material 18 is molten during the heating, and the molten brazing material 18 is supplied to the contact portion of fluid pipe 4 and tank wall 16 for brazing. The brazed state is shown in FIG. 4.

In this embodiment, because annular brazing material 18 is securely fixed between flange 4*b* and tank wall 16 before brazing, when the assembly is heated and brazed, the fixed annular brazing material 18 does not shift from the desired position during heating in a furnace, even if vibration occurs. Therefore, a sufficient amount of molten brazing material is always supplied to the connection portion between fluid pipe 4 and tank wall 16, and a good brazing state is achieved therebetween. A strong connection between fluid pipe 4 and tank wall 16 is thereby ensured.

Further, because inserted end portion 4*c* of fluid pipe 4 is outwardly expanded and caulked together with burr 17, the insertion length of end portion 4*c* of fluid pipe 4 in a direction toward the interior of tank 2 may be minimized. Therefore, any pressure loss in tank 2 caused by the inserted end portion 4*c* may be minimized as compared with the conventional structure.

Further, flange 4*b* of fluid pipe 4 comes into contact with the outer surface of tank wall 16 and caulked end portion 4*c* of fluid pipe 4 comes into contact with the surface of caulked burr 17 formed on tank wall. Therefore, fluid pipe 4 comes into contact with tank wall 16 over a sufficiently broad contact area, thereby further increasing the connection strength between fluid pipe 4 and tank wall 16.

Further, end portion 4*c* of fluid pipe 4 is caulked together with burr 17 so that the caulked surface is formed as a curved surface convex toward the interior of tank 2. Therefore, the pressure loss in tank 2 may be minimized as compared with, for example, a concave curved surface.

Furthermore, end portion 4*c* of fluid pipe 4 may be inserted into pipe connection hole 14 so as to extend over tip 30 of burr 17. Also, the inserted end portion 4*c* is caulked together with burr 17. Therefore, fluid pipe 4 may be extremely securely fixed to tank wall 16. As a result, when heated and brazed, the fluid pipe 4, particularly, fluid introducing port 4*a*, may be positioned and maintained at a desired position relative to tank member 2*a* without fixing fluid pipe 4 to tank member 2*a* using a specified jig. As a result, the manufacturing process may be simplified and the cost for manufacturing heat exchanger 1 may be reduced.

Figure 7:
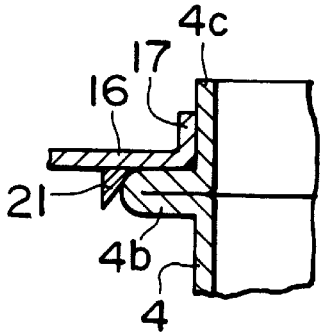
FIG. 7 is a vertical sectional view of part of a connection portion between a fluid pipe and a tank wall of a heat exchanger according to another embodiment of the present invention.
Figure 8:
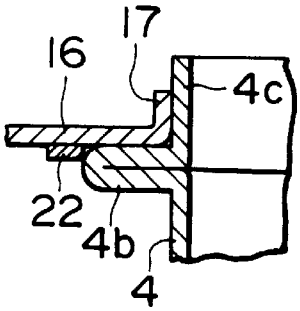
FIG. 8 is a vertical sectional view of part of a connection portion between a fluid pipe and a tank wall of a heat exchanger according to another embodiment of the present invention.
Figure 9:
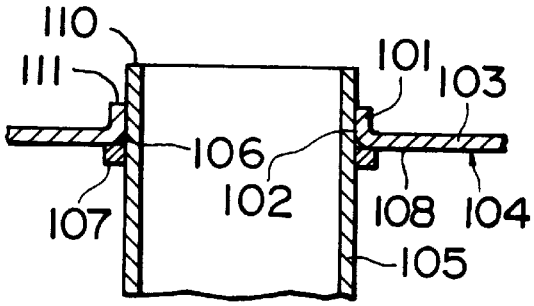
FIG. 9 PRIOR ART
FIG. 9 is a vertical sectional view of part of a connection portion between a fluid pipe and a tank wall of a conventional heat exchanger.

Although annular brazing material may have a trapezoidal cross section in the above-described embodiment, the cross-sectional shape is not particularly restricted. For example, an annular brazing material 21 having a triangular cross section before caulking may be employed according to another embodiment depicted in FIG. 7. Also, as a structure before caulking, an annular brazing material 22 having a rectangular cross section before caulking may be employed according to yet another embodiment depicted in FIG. 8.

Although several embodiments of the present invention have been described in detail herein, the invention is not limited thereto. It will be appreciated by those of ordinary skill in the art that various modifications may be made without materially departing from the novel and advantageous teachings of the present invention. Accordingly, the embodiments disclosed herein are by way of example only. It is to be understood that the scope of the invention is not to be limited thereby, but is to be determined by the claims which follow.

What is claimed is:

1. A method for manufacturing a heat exchanger having at least a tank and a fluid pipe connected to said tank for introducing a fluid into said tank or discharging said fluid from said tank, the method comprising the steps of:

forming a burr extending toward an interior of said tank around a pipe insertion hole displayed in a tank wall of said tank;

forming a flange on a periphery of said fluid pipe;

inserting an end portion of said fluid pipe into said pipe insertion hole so that said flange contacts an outer surface of said tank wall; and crimping said inserted end portion of said fluid pipe together with said burr, such that said burr is crimped against and contacts an inner surface of said tank wall.

2. The method of claim 1 further comprising the step of brazing the fluid pipe to the tank wall after said caulking step.

3. The method of claim 1 further comprising the step of placing an annular brazing material on the periphery of the fluid pipe at a position between the flange and the tank wall before said fluid pipe insertion step.

4. The method of claim 1, wherein said annular brazing material has a trapezoidal cross section.

5. The method of claim 1, wherein said annular brazing material has a triangular cross section.

6. The method of claim 1, wherein said annular brazing material has a rectangular cross section.

7. The method of claim 1, wherein said inserting step comprises inserting said end portion of the fluid pipe into said pipe insertion hole to extend over said burr.

8. A method for manufacturing a heat exchanger having at least a tank and a fluid pipe connected to said tank for introducing a fluid into said tank or discharging said fluid from said tank, the method comprising the steps of:

forming a burr extending toward an interior of said tank around a pipe insertion hole displayed in a tank wall of said tank;

forming a flange on a periphery of said fluid pipe;

inserting an end portion of said fluid pipe into said pipe insertion hole, so that said flange contacts an outer surface of said tank wall; and crimping said inserted end portion of said fluid pipe so that a surface of said crimped end portion facing said interior of said tank forms a curved surface convex toward said interior of said tank and contacts an inner surface of said tank wall.

9. The method of claim 1, wherein said forming step of the flange comprises a step of bending said fluid pipe onto itself.

10. The method of claim 8, further comprising the step of brazing said fluid pipe to said tank wall after said crimping step.

* * * * *